US005280758A

United States Patent [19]

Müller

[11] Patent Number: 5,280,758

[45] Date of Patent: Jan. 25, 1994

[54] AUTOMATIC SEWING MACHING FOR SEWING BANDS ONTO FABRIC PARTS

[75] Inventor: Ernst Müller, Tübach, Switzerland

[73] Assignee: Schips AG Nähautomationen, Tübach, Switzerland

[21] Appl. No.: 879,751

[22] Filed: May 6, 1992

[30] Foreign Application Priority Data

May 31, 1991 [EP] European Pat. Off. ..... 91108958.9

[51] Int. Cl.[5] ..... D05B 19/00; D05B 27/10

[52] U.S. Cl. ..... 112/121.11; 112/121.27; 112/318

[58] Field of Search ..... 112/121.27, 121.26, 112/152, 2, 121.11, 303, 307, 305, 318, 322, 150; 242/55

[56] References Cited

U.S. PATENT DOCUMENTS 4,462,326 7/1984 Perego et al. ..... 112/121.27 X 4,922,843 5/1990 Hyca ..... 112/121.27 X

FOREIGN PATENT DOCUMENTS 2524017 9/1983 France .

*Primary Examiner*—Peter Nerbun

*Attorney, Agent, or Firm*—Martin A. Farber

[57] ABSTRACT

In an automatic sewing machine for sewing bands onto fabric parts, a metering device (3) which meters the band is electronically coupled to the sewing machine via a position sensor (6) in the form of a pulse generator, a signal processing circuit (8) and a motor, for example a stepping motor (SM). The amount of band per unit time delivered by the metering device depends on the speed. On the other hand, the stitch length of the sewing machine is, however, not independent of the speed but becomes greater with increasing speed. The resulting, undesired tensions between the fabric part on the one hand and the band on the other hand are avoided by a correction means (10) between the pulse generator (6) and the sewing machine (2) and the driver circuit (12) of the stepping motor (SM) of the metering device (3). The correction device ensures that control signals reaching the driver circuit (12) result in corrected, excessive metering of the band at higher sewing machine speeds. This correction is possible not only in the case of bands but generally for elements which, depending on the speed of the machine drive, are transported relative to the pressure foot.

18 Claims, 2 Drawing Sheets

AUTOMATIC SEWING MACHING FOR SEWING BANDS ONTO FABRIC PARTS

FIELD AND BACKGROUND OF THE INVENTION

The invention relates to an automatic sewing machine having a transport apparatus for transporting a band element to the foot of a sewing machine.

Such an automatic sewing machine is used, for example, to sew rubber bands onto leg sections and onto the waistband of tricot fabrics. There are also known automatic sewing machines in which the fabric itself is transported with the aid of a band driven synchronously with the sewing drive. The invention is also used for this type of "bands".

Here, the term "automatic sewing machine" designates a system which essentially consists of a conventional sewing machine and additional means which are designed for special applications of the automatic sewing machine. Such additional means may be, for example, a special fabric feed means for feeding the fabric to the sewing point, and other possible additional means are a cutting apparatus (thread and band cutter) or an apparatus for inserting and sewing on labels.

The motor and its control circuit may be of the conventional type, for example a controllable direct current motor. A particularly interesting additional means here is a means which is generally referred to by the term "metering device" and which is specially designed in the form of so-called metering rollers, for synchronously feeding an element to be transported, namely a band.

In an automatic sewing machine of the type stated at the outset, such a metering device ensures metering of bands, for example rubber bands. These bands are transported to the sewing point under the pressure foot, so that they come to rest at the edge of the fabric and are sewn to the fabric edge. In the simplest case, fabric transport and the feed rate of the band are identical, so that there is no tension at all between fabric and band.

However, especially when sewing on rubber bands, frequently a difference is expressly required between the rate of advance of the fabric on the one hand and the feed rate of the rubber band on the other hand, in order to achieve a certain gathering or crimping of the fabric in the region of the rubber band. Previously, automatic sewing machines had a mechanical coupling between the sewing machine drive and the metering device. In modern automatic sewing machines, such a mechanical coupling is replaced by an electronic coupling: in general, a pulse generator on the sewing machine opto-electrically scans the speed of the sewing machine drive and sends a speed-dependent pulse signal to a signal processing means, which in turn controls the driver circuit of the stepping motor of the metering device. In principle, however, other (for example analogue) position or speed signals are also possible, as are different motors, which are synchronous or direct current motors.

The electronic coupling between the sewing machine and the band metering device has a number of advantages. The gathering or crimping of the fabric which can be achieved by different speeds of the fabric on the one hand and the band on the other hand depends on the position at which the band is sewn onto the fabric.

For different fabric regions, it is frequently necessary to provide different rates of advance of the band in order to achieve different tensions at the relevant sewing points. In the case of the electronic coupling between the sewing machine and the metering device, the desired band tension relative to the fabric can be easily preset with the aid of a simple switch arrangement, with matrix plugs, potentiometers or key pads.

The ratio of fabric advance to tape metering is constant if it is assumed that the stitch length of the sewing machine is independent of the speed of the sewing machine drive.

However, it has now been found that the stitch length L is not independent of the speed of the sewing machine drive but increases with increasing speed. FIG. 1 shows the dependence of the stitch length L, measured in millimeters, on the speed of the sewing machine drive, measured in rpm, by way of example in a graphical representation. In the ideal case, there would be a constant stitch length L of, for example, 2 mm, independent of the speed. The stitch length L multiplied by the number of stitches per unit time gives the advance of the fabric. With a constant stitch length L, a fabric advance proportional to the speed was thus also obtained. The pulse generator coupled to the sewing machine drive sends a correspondingly large number of pulses per unit time at high speeds. Accordingly, the metering device delivers larger amounts of band at higher speeds.

If the stitch length is considered in relation to the fabric on the one hand and in relation to the band on the other hand, the conditions shown in FIG. 1 are obtained:

In the ideal case, regardless of the speed, the stitch length L at the fabric on the sewing machine is constant and, for example, has a value of 2.0 mm. Hence, in the ideal case, the stitch length L has a constant value of, for example, 2.0 in relation to the rubber band, once again regardless of the speed.

In practice, however, the stitch length is not constant but changes with increasing speed of the sewing machine drive, the change generally being an increase. This is indicated in FIG. 1 by a — ' — line Nr, which deviates from the ideal line $N_i$.

In the older sewing systems of the type under discussion here, having mechanical coupling between the sewing machine and the metering device (MD), there was, so to speak, an automatic correction by virtue of the fact that the metering device also delivered correspondingly more band at higher speeds, i.e. a disproportionately large amount of band relative to the speed. There were therefore virtually no defects in the sewn article since the desired tension between the fabric and the band was achieved in each case.

If the speed is now picked up at the sewing machine drive by means of a pulse generator and this speed is converted into control signals for an electric stepping motor, the metering device delivers twice as much band per unit time at twice the speed. Thus, the stitch length L remains constant in relation to the metered band while the stitch length L of the sewing machine (in relation to the transported fabric) changes at higher speed, whereby the resulting error curve can be very different, but will rise in many cases.

Due to the above-mentioned circumstances, the sewn product exhibits defects in so far as the desired tension, which is set differently depending on the sewn material, between the fabric and the band is irregular, i.e. too high at some points and too low at other points.

In FIG. 1, the metering with the aid of a mechanically coupled metering device is designated by MD mech. The dash-dot line parallel to the abscissa indicates the ideal relationship of sewing machine speed and stitch length L of the sewing machine, as well as the relationship between stitch length L, relative to the band, and the speed of the sewing machine.

SUMMARY OF THE INVENTION

It is the object of the invention to provide an automatic sewing machine of the type stated at the outset, in which the product defects due to undesired rates of advance of the fabric on the one hand and of the band to be sewn on on the other hand are to be avoided.

This object is achieved, according to the invention, by a correction means which, independently of the sewing machine speed represented by the signals sent by the position sensor, corrects the control signals for the motor driver circuit so that a certain constant ratio exists between the stitch length and the transport of the element, for example of a band to be sewn on, in the entire speed range.

This measure according to the invention can be implemented in practice in various ways. The principle is to be explained with reference to FIG. 1.

At a speed of slightly more than 3000 rpm, there is a discrepancy between the amount of band delivered by the metering device on the one hand and the stitch length L of the sewing machine on the other hand. This difference $\Delta S_2$ is not the same as the difference $\Delta S_1$ which is present at 6000 rpm. In other words, the tension between the band and the fabric is substantially greater when high speeds are used than when sewing is carried out at relatively low speeds.

By the measure according to the invention, corrected metering of the band is now achieved. This corresponds to a characteristic $MD_{korr}$ which is parallel to the uppermost curve in FIG. 1. There is the case where there should be no tension at all between the fabric and the band. The two characteristics Nr and $MD_{korr}$ then coincide. In the example according to FIG. 1, there is a difference $\Delta X$ independent of the speed, so that a constant tension is achieved between the fabric and the band, regardless of the speed.

To realize the proposal according to the invention, it is possible to ensure that the correction means provides a speed-dependent correction factor for the control signals or for the pulses delivered by the pulse generator. The pulses delivered by the pulse generator can, prior to signal processing in the signal processing means, be corrected by a correction factor which is dependent on the speed and influences the frequency of the pulses in a manner corresponding to the characteristic Nr shown right at the top in FIG. 1. If, for example without a correction, the pulses would be delivered at a frequency of 1000 Hz at a speed of 3000 rpm and the pulses would be delivered at a frequency of 2000 Hz at a speed of 6000 rpm, the correction means ensures that pulses with a frequency of 1100 Hz are delivered at a speed of 3000 rpm and pulses with a frequency of 2250 or 2300 Hz are delivered at a speed of 6000 rpm.

As explained above, the correction means can be arranged directly behind the pulse generator. However, it may also be arranged for the driver circuit for the stepping motor. This is not the same in every case, because the signal processing means also contains a tension adjusting means, which is usually coupled with a knee switch, a pedal, a key pad or another switch means, so that the operator can set a certain tension between a fabric and a band, depending on the part onto which the band is to be sewn.

In a special embodiment of the invention, the correction means is provided with a multiplier or divider circuit which receives a speed-dependent signal at one input and, depending on this, sends a corrected signal which differs from the received signal by a speed-dependent factor. Accordingly, the frequency $f_O$ of the output signal of the correction means is related to the input frequency $f_I$ via a speed-dependent correction factor K:

$$f_O = K(n) \times f_I.$$

The speed-dependent correction factor may be expressed by the formula $1+\alpha(n)$, where $\alpha$ is likewise the speed-dependent correction factor. In this case, the following relationship is obtained:

$$f_O = (1+\alpha(n)) \times f_I = f_I + \alpha(n) \times f_I.$$

According to this relationship, the invention alternatively envisages that the correction means will have an adding circuit which receives the speed-dependent input signal at one input and, at another input, the correction signal which is likewise speed-dependent. The relationship according to the above equation is realised by such a circuit.

In practice, the correction means according to the invention, of the signal processing means, is combined to give a control which is formed, for example, by a microprocessor. In this case, the correction means contains, for example, a read only memory which is addressed by a speed-dependent signal and contains, in its memory locations, the corrected signals or correction signals which correspond to the stitch length/speed characteristic of the sewing machine. During operation of the sewing machine, addressing of the read only memory varies depending on the speed, and the read only memory gives correspondingly different corrected signals or correction signals. The corrected signals can be accepted more or less unchanged as control signals for the control circuit of the motor. The correction signals can, for example, be multiplied with or added to the speed-dependent signal.

Embodiments of the invention are described in detail below with reference to the drawing.

FIG. 1 shows a stitch length/speed characteristic for the sewing machine having a metering device, FIG. 2 shows a schematic block diagram of a sewing machine having an electronic control including a correction means, FIG. 3 shows a first alternative embodiment for the control according to FIG. 2 and FIG. 4 shows a further variant.

DETAILED DESCRIPTION OF THE PREFERRED EMBODIMENTS

Figure 2:
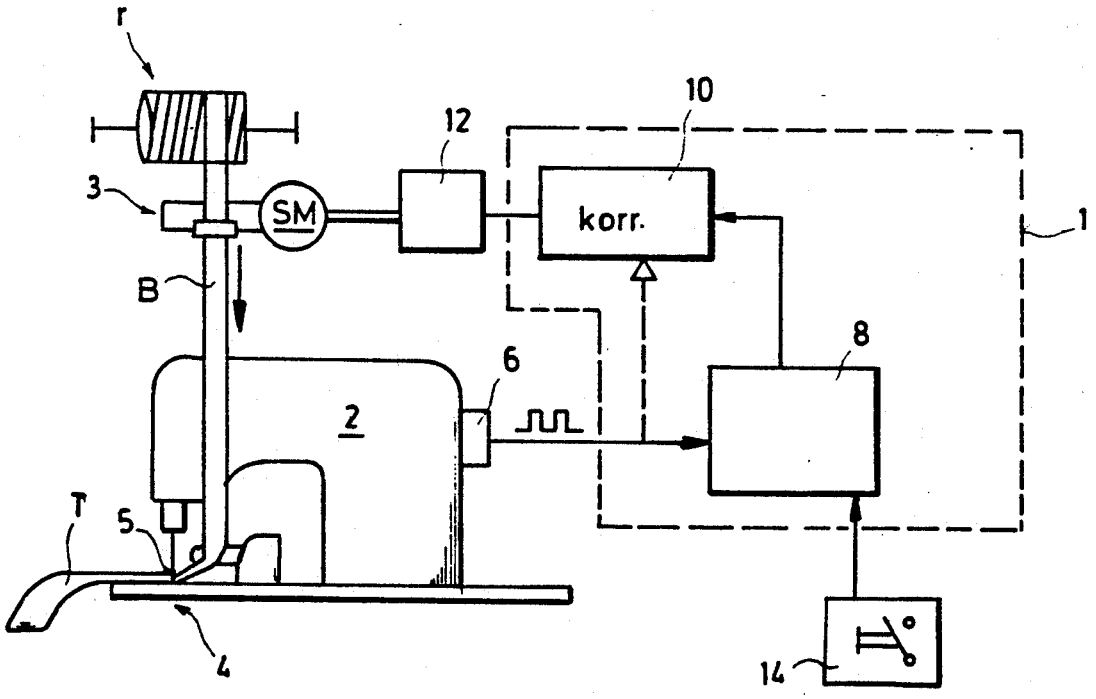

FIG. 2 schematically shows an automatic sewing line having a conventional sewing machine 2 and a metering device 3 (MD). The metering device 3 delivers a rubber band B to a sewing station 4, where the rubber band B is sewn onto the waistband of a fabric piece T. The fabric piece T is, for eample, a pair of swimming trunks.

A pulse generator 6 which delivers pulses to a control circuit 1 as a function of the speed of the sewing machine drive is coupled to the drive of the sewing machine 2. The control 1 contains a signal processing circuit 8 and a correction means 10.

A switch 14 indicates a tension changing apparatus, by means of which the tension which can be produced between the band B and the fabric piece T is adjustable. Depending on the nature of the article, a high or a low tension is set. In the case of a high set tension, the signal processing circuit 8 delivers relatively few pulses, so that the band B is fed relatively slowly in relation to the transport speed of the fabric.

Figure 1:
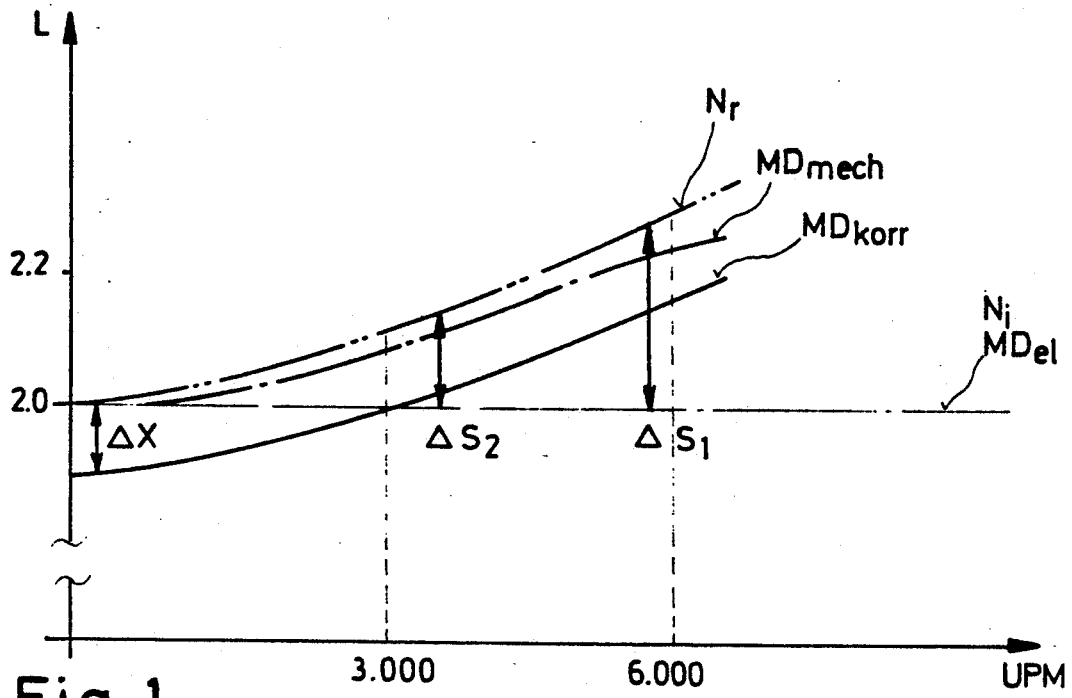

The correction means 10, which may be coupled to the output of the pulse generator 6, corrects the pulse signals delivered by the signal processing circuit, so that there is always a certain ratio between the stitch length and the band metering. In other words, the correction means ensures that the difference $\Delta X$ between the characteristic Nr on the one hand and $MD_{korr}$ on the other hand, shown in FIG. 1, regardless of the speed is determined with the aid of the pulse generator 6 and the signal processing circuit 8. As seen in FIG. 1, $N_r$ represents the relationship between the stitch length and the speed of the sewing machine and $MD_{korr}$ represents the relationship between corrected transport length over which the band (B) is transported and the speed of the sewing machine. Such a difference $\Delta X$ may be zero but expediently has a small finite value in order to ensure a certain tension for the feed of the band B. This value may be up to 50%, for example 10 to 30%.

The correction circuit contains, for example, a read only memory (ROM) in which correction signals for different small speed ranges are stored beforehand according to the characteristic shown in FIG. 1. The pulse signal is used for addressing the read only memory, and different correction signals are output depending on the speed. These correction signals are transmitted, together with the signal delivered by the signal processing circuit 8, to an addressing means, so that the output signal of the addressing means finally gives control signals to a drive circuit 12 of a stepping motor SM of the metering device 3.

The metering device 3 is designed in a manner known per se. The band B is metered from a schematically indicated storage reel r by rollers driven by the stepping motor SM and is fed to the sewing station 4.

Figure 3:
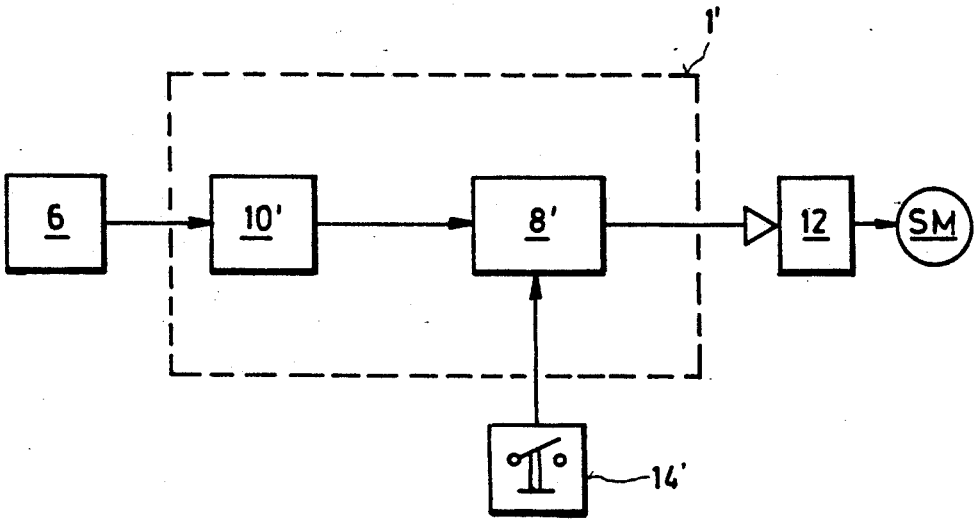

In the modified embodiment according to FIG. 3, the pulses delivered by the pulse generator 6 are sent directly to a correction means 10' in a control 1', and the corrected pulse signals are further processed by a signal processing circuit 8', which is coupled to the tension switch 14. The output for the signal processing circuit 8' is coupled to the driver circuit 12 of the stepping motor.

In FIG. 3, the modified control is designated by 1'.

The correction means 10' multiplies the signal delivered by pulse generator 6 by a speed-dependent correction factor corresponding to the characteristic according to FIG. 1. This means that the correction means in principle simulates the given error curve for comparison.

Figure 4:
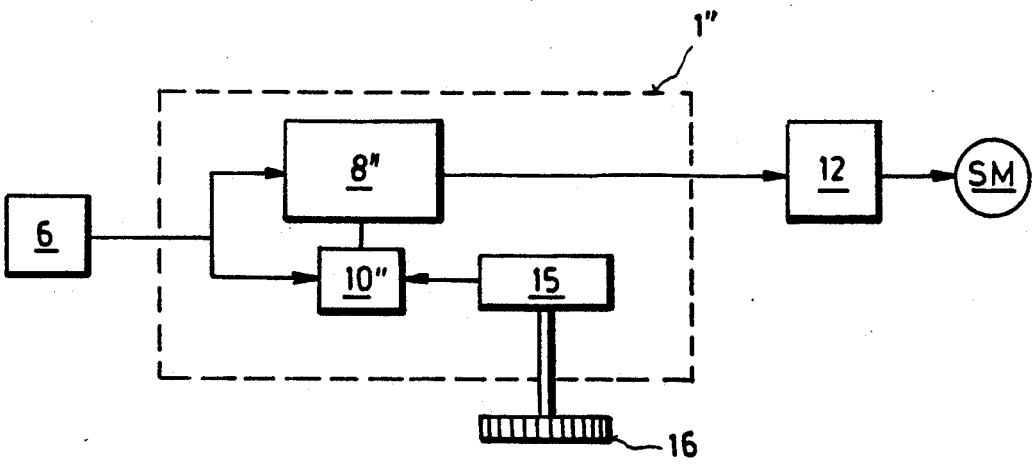

In a further embodiment shown diagramatically in FIG. 4, the pulses delivered by the pulse generator 6 are transmitted in a control 1", to a signal processing circuit 8" on the one hand and a correction means 10". The latter receives signals from an adjusting means 15 which can be set from outside by means of an adjusting knob 16 in order to deliver signals to the correction means 10", depending on the position of the adjusting knob. The driver circuit 12 then receives signals for the stepping motor SM from the signal processing circuit 8".

Further modifications of the invention are possible within the scope of the Patent Claims; for example, a mechanical drive, in particular for the band drive means 3, for example with coupling or free-running, may be provided as the drive.

While the above description of an embodiment relates to a band B to be sewn onto a fabric part, the band B may be replaced with another element to be transported to the foot of the sewing machine, for example a transport element which is provided for advancing the fabric.

I claim:

1. Automatic sewing machine for sewing fabric parts, comprising a transport apparatus by which a band element is transported as a function of the speed of a drive of the sewing machine to the foot of the sewing machine;

a position sensor coupled to the sewing machine drive;

a motor control circuit, and a signal processing circuit which processes signals generated by the position sensor and sends control signals to the motor control circuit for providing transport movement of said band element at a particular speed;

correction means for correcting the control signals as a function of the drive speed of the sewing machine and correcting said particular speed such that said particular speed deviates from synchronism with said speed of drive of the sewing machine by a speed dependent correction factor so that there is a constant ratio of a stitch length to a transport length over which the element is transported in the entire speed range;

wherein the correction means is operative to provide said ratio based on the elasticity of the material of said band element.

2. Automatic sewing machine according to claim 1, wherein a multiplier or divider circuit is provided in the correction means and gives, at one input, a signal which is dependent on the speed of the sewing machine drive and which differs from a received signal by a speed-dependent factor.

3. Automatic sewing machine according to claim 1, wherein the correction means has an addressing circuit which receives the speed-dependent input signal at one input and, at the other input, a correction signal which is likewise speed-dependent.

4. Automatic sewing machine according to claim 1, wherein the correction means has a read only memory (ROM) which is addressed by a speed-dependent signal and stores in its memory location corrected signals or correction signals which correspond to the stitch length/speed characteristic of the sewing machine.

5. Automatic sewing machine according to claim 1, wherein the transport apparatus is in the form of a metering device, by means of which the band element to be sewn onto a fabric part is transported.

6. Automatic sewing machine according to claim 5, further comprising guide means on the pressure foot;

wherein the band element delivered by the metering device is fed under the pressure foot by the guide means on the pressure foot.

7. Automatic sewing machine according to claim 1, wherein the position sensor is in the form of a pulse generator, the signal processing circuit processes the pulses generated by the pulse generator, and the motor control circuit is in the form of a stepping motor driver circuit.

8. An automatic sewing machine for sewing fabric parts at a first speed variable within a predetermined range, said machine comprising means for providing stitches of a desired stitch length;

transport means for transporting one of said fabric parts to said stitch means, said transport means including motor means for providing transport movement at a second speed, and motor control means for controlling said second speed;

sensing means for sensing the position of the sewing machine shaft to supply an output signal dependent on said first speed;

control means receiving said output signal for controlling said second speed of said motor means, said control means including signal processing means for substantially providing a synchronism between said first and said second speeds, and correction means for providing a speed dependent correction signal depending on said first speed, and correcting said second speed such that said second speed deviates from synchronism with said first speed by a speed dependent correction factor based on the elasticity of the material of said one fabric part to ensure a constant ratio between said stitch length and said second speed within a whole range of said variable first speed.

9. Machine as claimed in claim 8, wherein said correction means comprise a calculating circuit having an input for receiving said output signal of said sensing means and proving said correction signal by arithmetically combining a speed dependent correction factor with said output signal.

10. Machine as claimed in claim 9, wherein said calculating circuit comprises a multiplier circuit.

11. Machine as claimed in claim 9, wherein said calculating circuit comprises an adding circuit receiving said output signal of said sensing menas and correcting signal for adding them.

12. Machine as claimed in claim 8, wherein said correction means comprise addressable memory means containing speed-dependent values, said control means receiving said output signal of said sensing means to provide a speed-dependent address.

13. Machine as claimed in claim 12, wherein said speed-dependent values correspond to said correction signal.

14. Machine as claimed in claim 12, wherein said speed-dependent values correspond to said correction factor.

15. Machine as claimed in claim 12, wherein said memory means comprise a read-only memory.

16. Machine as claimed in claim 8, wherein said transporting means comprise at least two metering rolls for feeding a band.

17. Machine as claimed in claim 8, wherein said motor means comprise a stepping motor, and said motor control means comprise a stepping motor driving circuit.

18. Machine as claimed in claim 8, wherein said sensing means comprise a pulse generator delivering pulses of speed-dependent frequency.

* * * * *